US005896838A

United States Patent [19]

Pontopiddan et al.

[11] Patent Number: 5,896,838

[45] Date of Patent: Apr. 27, 1999

[54] INTAKE MANIFOLD FOR INTERNAL COMBUSTION ENGINE

[75] Inventors: Michaël Pontopiddan, Rueil Malmaison; Georges Evieux, Villeneuve La Garenne, both of France

[73] Assignee: Magneti Marelli France, Nanterre, France

[21] Appl. No.: 08/945,755

[22] PCT Filed: May 7, 1996

[86] PCT No.: PCT/FR96/00689

§ 371 Date: Feb. 15, 1998

§ 102(e) Date: Feb. 15, 1998

[87] PCT Pub. No.: WO96/35869

PCT Pub. Date: Nov. 14, 1996

[30] Foreign Application Priority Data

May 10, 1995 [FR] France ..... 95 05534

[51] Int. Cl.[6] ..... F02M 35/10

[52] U.S. Cl. ..... 123/184.47

[58] Field of Search ..... 123/184.24, 184.34, 123/184.42, 184.47

[56] References Cited

U.S. PATENT DOCUMENTS

| | | | |
|---|---|---|---|
| 4,111,163 | 9/1978 | Ederer et al. | 123/184.42 |
| 5,063,885 | 11/1991 | Yoshioka | 123/184.34 |
| 5,150,669 | 9/1992 | Rush, II et al. | 123/184.42 |

*Primary Examiner*—Marguerite McMahon
*Attorney, Agent, or Firm*—Henderson & Sturm

[57] ABSTRACT

Between the two half-molds (2, 3) fixed against each other in order to form an envelope (1), one-piece blow-molded air tubes (12*a*, 12*b*) are mounted; the outlet (14*a*, 14*b*) of the tubes is held in a half-mold (3) by means of a fixing clamp (6) to the cylinder-head of the engine while being sealingly connected to an opening (7) of the clamp (6) for supplying one cylinder by means of a tubular nozzle formed of a cradle (20*a*, 20*b*) molded with the clamp (6) and the half-mold (3), and a staple (22*a*, 22*b*) fixed to the cradle to hold a ring (17) on the outlet of the tube while compressing a seal (18) between the tubes (12*a*, 12*b*) and the nozzle. Application particularly to intake manifolds of engines with multipoint injection and controlled ignition.

13 Claims, 3 Drawing Sheets

Figure 1:
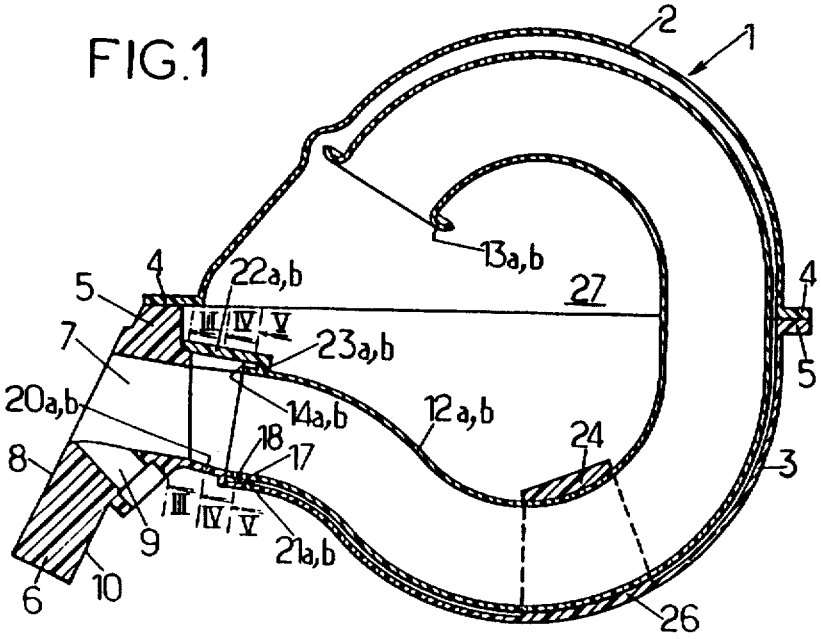

FIG. 6
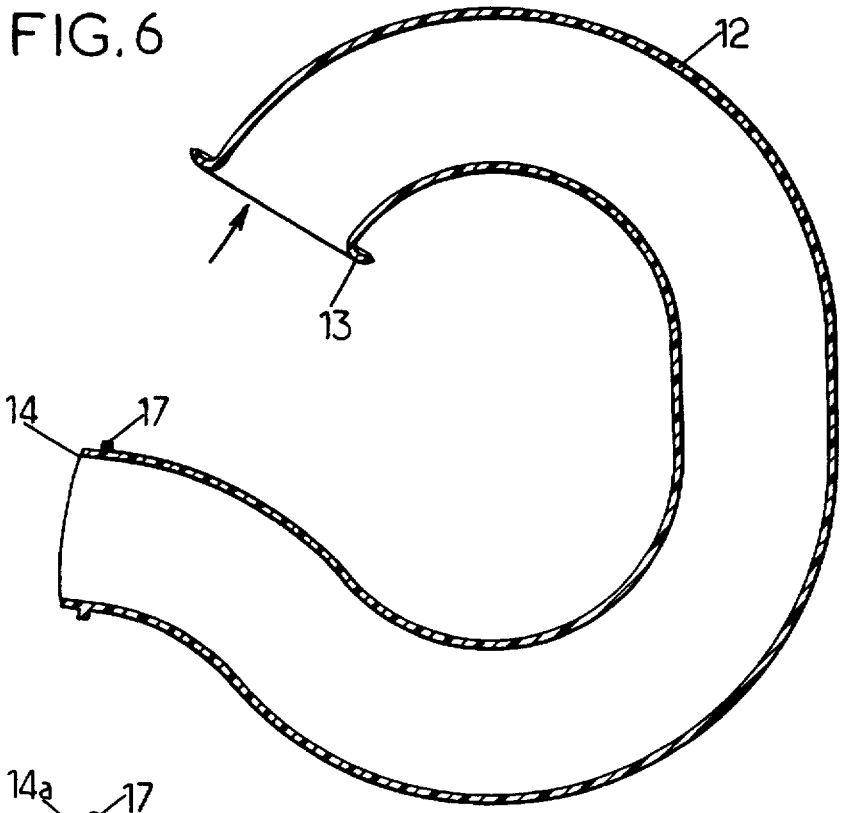
FIG. 7
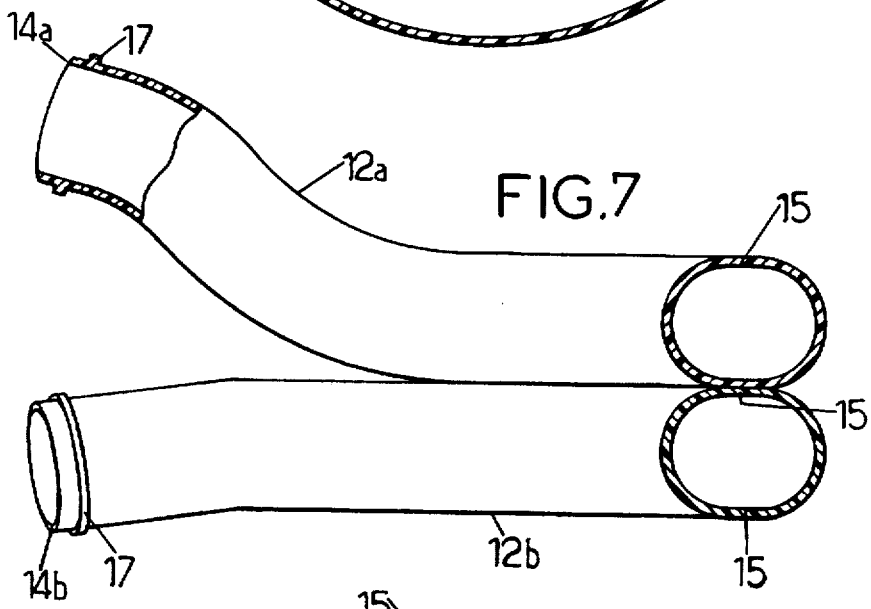
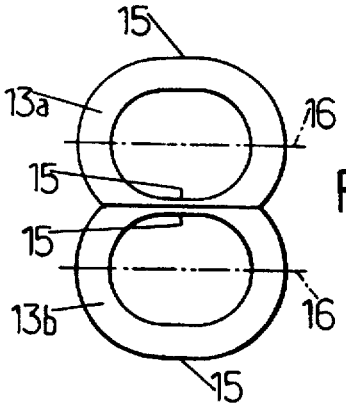
FIG. 8

FIG.12.
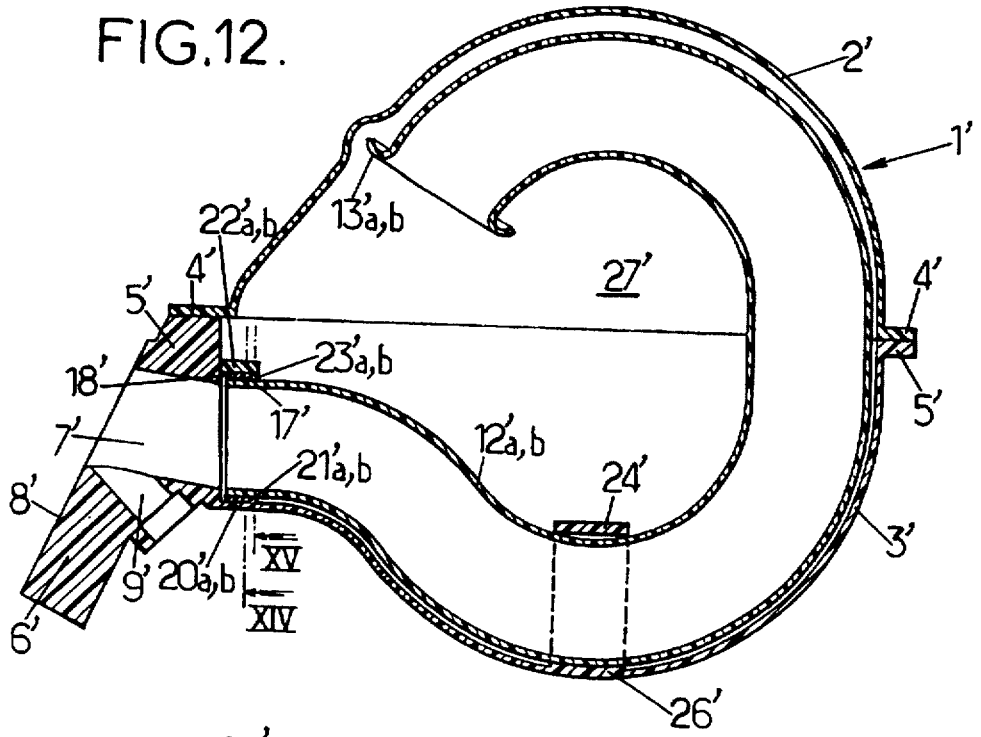
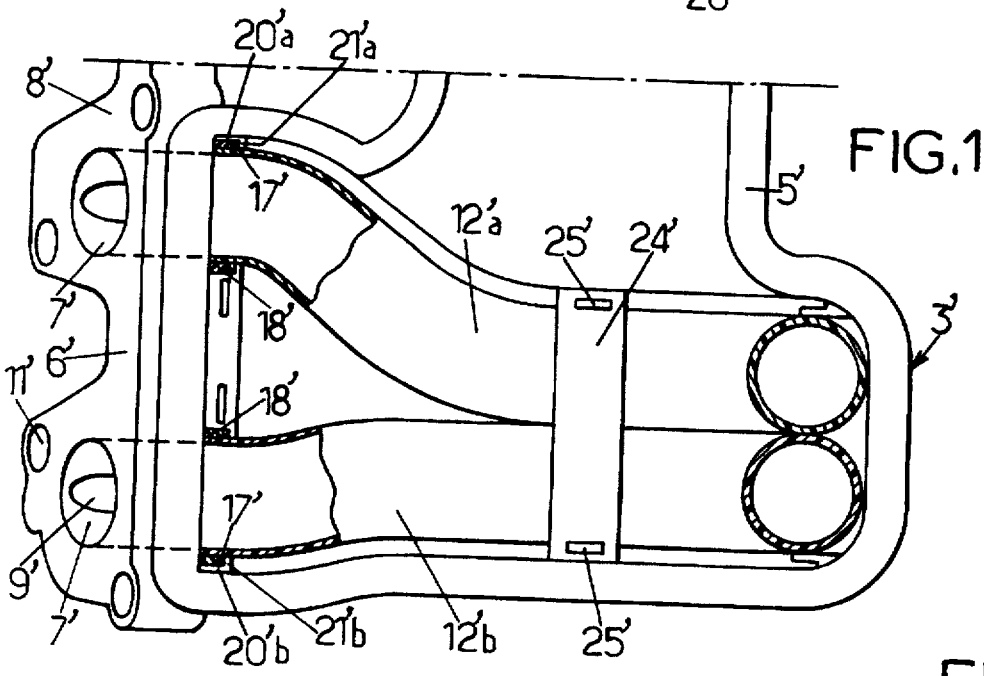
FIG.13.
FIG.16.
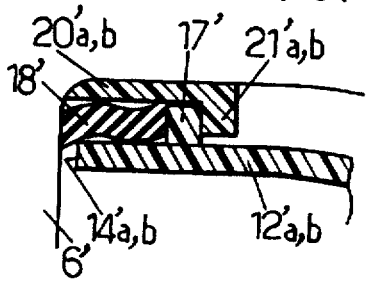
FIG.14.
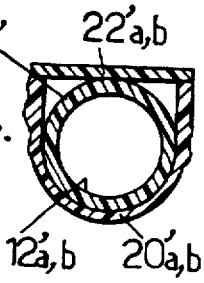
FIG.15.
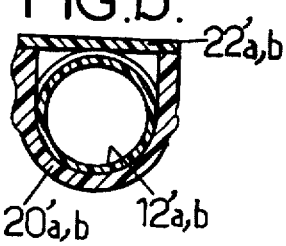

INTAKE MANIFOLD FOR INTERNAL COMBUSTION ENGINE

The invention relates to an inlet manifold for an internal combustion engine equipped with a fuel-supply installation preferably by injection, particularly of the so-called "multipoint" type comprising, for each cylinder of the engine, at least one injector which injects fuel into an induction pipe of the inlet manifold that allows air into the engine, directly upstream of the cylinder head of the engine and of the inlet valve or valves of the corresponding cylinder.

More specifically, the invention relates to an inlet manifold of this kind, more particularly intended to be fitted to a controlled-ignition engine and which comprises, as disclosed in U.S. Pat. No. 5,003,933:

an envelope, delimiting a plenum chamber intended to be supplied with air for supplying the engine via a variable-delivery valve, such as a butterfly valve, and equipped with at least one flange for attaching it to a cylinder head of the engine, said flange or flanges having at least one opening for supplying each cylinder of the engine, each supply opening opening, on the one hand, into the envelope and, on the other hand, into a face for attaching the flange to said cylinder head, and curved air-induction tubes, each made as a single piece with the desired shape, and of which there are at least as many as there are cylinders in the engine, and which are mounted in the envelope so that each tube supplies a corresponding cylinder with air which the tube receives via its inlet in the plenum chamber and which the tube transmits to a corresponding opening in a flange via its outlet connected to said supply opening by leaktight connection means comprising a tubular end piece in which the outlet end part of said tube is held in said envelope, with the insertion of at least one flexible seal between the tube and the end piece.

The manufacturing of similar manifolds by molding two half shells with complementary shapes corresponding to the shape of the envelope and which are intended to be secured together via their peripheral edge, in a parting plane, to form the envelope is already known.

The outer part, with respect to the center of curvature of the curved tubes, of the collection of air tubes may be formed by the bottoms of cavities molded as hollows in each of the two half shells and which extend one another when the half shells are closed one against the other. Similarly, the inner part of the collection of air tubes may be formed by the bottoms of cavities molded as hollows in two molded inserts, generally made of the same material as the half shells, for example of polyamide filled with reinforcing fibers, each attached to one of the half shells respectively, so that the cavities of the inserts also extend one another when the half shells are secured together. This method therefore makes it possible to form the tubes by the cooperation of surfaces presented by at least four molded parts (two half shells and two inserts) joined together.

A manifold produced in this way is suitable for fitting to a diesel engine, because of the low pressure gradient between the atmosphere and the plenum chamber of the manifold when the engine is running.

By contrast, in a controlled-ignition engine, where this pressure gradient may attain higher mean values, of the order of 70 kPa, when the engine is running, the presence of air leaks between the parts which are assembled to form the air induction tubes contained inside the plenum chamber has the effect of altering the acoustic impedance of the manifold and thus of lowering the efficiency of the engine.

It is therefore essential for a manifold of this type to be correctly sealed, especially at the air tubes.

For this, a seal needs to be made between the inserts and the half shells by depositing runs of an appropriate polymerizable material, which is a lengthy and tricky operation which combines with the difficulty of producing, to tight tolerances, the four parts to be assembled to define the air tubes accurately.

In the case of a manifold according to U.S. Pat. No. 5,003,933, each air tube is either made as a single piece with the desired shape, as already mentioned above, or made by assembling two complementary halves molded to shape. However, this assembly, despite the precautions taken, does not generally make it possible to obtain an internal surface of each tube which is completely smooth and continuous without roughnesses from its inlet to its outlet unless this surface is finished using a special machining operation, when the geometry of the tubes permits this.

The result of this is that a manifold of this kind may become expensive to produce.

The problem underlying the invention is that of proposing a manifold which has an advantageous structure, particularly for connecting each tube to the flange that attaches the manifold to the cylinder head of the engine, the structure being essentially made of a thermomoldable plastic and semi-modulable because a manifold of this kind can be acoustically matched to an entire family of engines of different cylinder capacities by adjusting the dimensions, and being capable of being produced using a more economical method of manufacture.

For this, the inlet manifold according to the invention, of the type explained hereinabove, is characterized in that each end piece is made with, on the one hand, a cradle integral with said attachment flange and projecting in the opposite direction to the cylinder head, in line with said corresponding supply opening, the cradle being of a more or less semi-cylindrical shape, of which the end inside said envelope has an annular end wall forming a stop projecting toward the inside of the cradle and, on the other hand, a stirrup piece for holding said tube in said cradle, the stirrup piece having a stop projecting toward the inside of the cradle and facing the annular end wall of the cradle, a ring being attached and fixed around said tube close to its air outlet, said flexible seal being attached around said tube between said ring and said air outlet of the tube, the outlet end part of said tube with said ring and said seal being in place in said corresponding cradle in such a way that the ring or the seal is retained by butting against said annular end wall of the cradle, said stirrup piece being attached to said cradle and that part of the tube which is held therein, and being fixed to the edges of the cradle.

Advantageously too, the internal surface of each tube is smooth and continuous from its inlet to its outlet, which is to be understood as meaning that this internal surface has no roughnesses or changes in level between two adjacent parts of the internal surface greater than about 200 μm.

As one-piece air tubes are, by definition, leaktight, the need to produce runs of sealant or welds for connection between two complementary halves disappears.

The inlet manifold according to the invention can essentially be distinguished from manifolds in the state of the art by the way in which the air induction tubes are manufactured and by the way in which each tube is connected to the flange that attaches the manifold to the cylinder head of the engine.

The inlet manifold according to the invention is advantageously one such that its envelope comprises two molded half shells with complementary shapes corresponding to the shape of the envelope and arranged one against the other and secured together by their peripheral edge, in a parting plane, to form the envelope with the tubes between them, each tube being blow-molded, and preferably suction blow-molded, from a thermomoldable plastic, and said attachment flange being integral with one of the half shells.

Advantageously, the manifold is also such that each tube is made with a section that decreases progressively in the downstream direction over at least part of its length and/or with a convergent bell-socket-shaped air inlet; each tube may be made with a section that has more or less the same shape from its air inlet to its air outlet, and which may be a circular or, advantageously, as specified below, an oval, section.

Advantageously too, to make it easier for the air tubes to be fixed into the half shells, the tubes are grouped at least in pairs of tubes that touch over at least part of their length, and the tubes of each group of tubes are fixed into one and the same half shell which has a flange for attaching to the supply openings to which the tubes of said group are connected in leaktight manner, using at least one stirrup piece which transversely straddles the touching tubes of said group, in their touching part, and which is attached via its ends to said half shell.

For this, it is advantageous for each tube to be made with an oval section and flats, parallel to the major axis of its section, on its opposed facing faces, and the tubes are grouped together, touching along their flats.

In a simple way, the half shells with their bases, on the one hand, and the second stirrup pieces, on the other hand, may be components molded from plastic, and the second stirrup pieces may be fixed to the corresponding half shell by welding or snap riveting.

Advantageously too, the tubes may be made curved with a radius of curvature, in the plane containing their axis, smaller than that of the envelope, the half shells of the envelope being molded of plastic with securing flanges along their edges in the parting plane, and the half shells are secured together to form the envelope by welding, preferably vibration welding, at the securing flanges. This is because this tube geometry in which the tubes are curved with respect to the geometry of the envelope, and the method of fixing the tubes into the half shells, both of which avoid points of contact, and therefore rubbing between the tubes and the half shells, allow the half shells to be secured economically by vibration welding at their securing flanges, in a known way, without any risk of breaking the tubes.

Advantageously also, each end piece holds a corresponding tube on one of the half shells to which each cradle is secured.

In particular, when the tubes have a circular cross section, the seal may be provided between the outlet end part of each tube and the corresponding end piece by axially compressing said seal, which is cylindrical, via its flat end faces between a flat radial face pointing toward the outlet of the tube, of the ring of the tube and a flat radial face, pointing toward the inside of said envelope, of the cradle and of said flange, said radial faces being more or less perpendicular to the axis of the tube at its outlet.

By contrast, when the air tubes advantageously have an oval cross section, as specified above, it is advantageous for each cradle and the corresponding stirrup piece to be molded in such a way that the end piece formed by the cradle and the stirrup piece should have a cross section that changes progressively from a circular shape, on the same side as the attachment flange and its circular supply opening, to an oval shape that complements that of the tubes.

In this case, the seal between the outlet end part of each tube and the corresponding end piece is advantageously provided by radially compressing said seal between, on the one hand, the tube and, on the other hand, the cradle and the corresponding stirrup piece.

Figure 3:
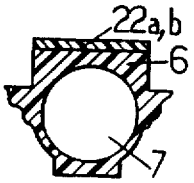
Figure 4:
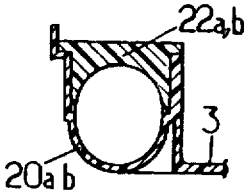
Figure 2:
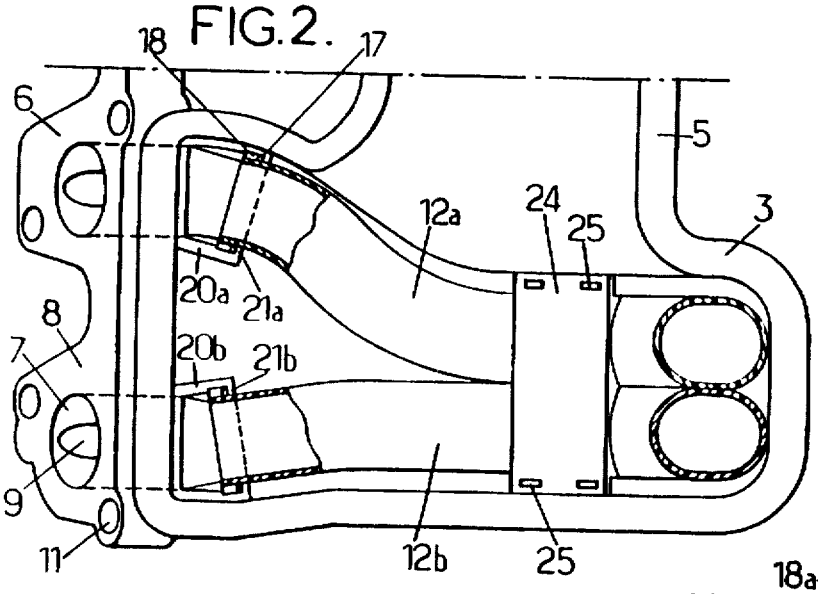
Figure 5:
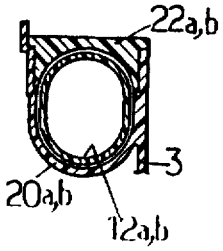

Other features and advantages of the invention will emerge from the description given hereinbelow without implied limitation of some embodiments which are described with reference to the appended drawings in which:

FIG. 1 is a view in cross section of a manifold for an engine with four in-line cylinders, the section being taken more or less at right angles to the axis of the engine, FIG. 2 is a half view partly in plan and partly in section of the downstream or lower half shell of the manifold of FIG. 1, with one of the two pairs of tubes which are grouped together and held in this half shell, FIGS. 3, 4 and 5 are cross-sections on III—III, IV—IV and V—V of FIG. 1, respectively, FIG. 6 is a view in axial section of an air tube, FIG. 7 is a view partly in section and partly in vertical elevation of the pair of two grouped-together tubes depicted in FIG. 2, before it is mounted in corresponding half shell, FIG. 8 is a diagrammatic front view of the air inlets of the two tubes of FIG. 7, viewed in the direction of the outward from their edges, by vibration welding at these flanges 4 and 5 after four air-induction tubes (one per cylinder of the engine) grouped into two pairs of touching tubes as depicted in FIG. 2, and described hereinbelow with reference to FIGS. 6 to 8, have been mounted in the half shells 2 and 3.

The flange 5 of the half shell 3, which faces the flange 4 of the half shell 2 over the entire periphery of the half shells, is supported, on one side of the envelope 1, by the upper part of a flange 6 for attaching the manifold to the cylinder head of the engine, this flange 6 being molded as a single piece with the half shell 3 and its peripheral flange 5. For each cylinder of the engine, the flange 6 has a supply opening 7, formed integrally by molding, with a circular cross-section, which opens on one side into the flat face 8 for attaching the flange 6 to the cylinder head of the engine and, on the other side, into the half shell 3 which is the lower half shell in FIG. 1 and known as the downstream half shell because it is intended to house the downstream parts of the air tubes, as opposed to the half shell 2 which is the upper half shell in FIG. 1 and known as the upstream half shell because it is intended to house the upstream parts of the air tubes. For each cylinder, the flange 6 also has a housing 9 for a fuel injector, this housing 9 opening into the face 10 of the flange 6 which is the opposite face to the face 8 for attaching to the cylinder head, and on the outside of the half shell 3, on the one hand and, on the other hand, each housing 9 opens into a corresponding supply opening 7. Finally, the flange 6 has holes 11, also formed integrally by molding like the openings 7 and the housings 9, for the passage of members for attaching the manifold to the cylinder head.

The manifold also comprises a bent air-induction tube for each cylinder, namely, as already stated, four air tubes grouped into two pairs of tubes that touch over a part of their length.

Each tube, like the tube 12 in FIG. 6, is a bent tube molded as a single piece of a thermomoldable plastic that can be blow molded, or more precisely be produced by the known method of suction-blow molding. This then yields a tube 12 which is lightweight, relatively rigid, thin-walled and leaktight, with smooth internal and external surfaces. In particular, the internal surface of the tube 12 is smooth and continuous from its inlet to its outlet. Smooth and continuous should be understood to mean that this internal surface has no roughnesses or changes in level, between two adjacent parts of the surface, exceeding about 200 μm.

In this example, each tube such as 12 is molded with an air inlet 13 in the shape of a volute or bell housing that converges toward the downstream end, and the surface area of the cross section of the tube decreases progressively from its inlet 13 to its outlet 14, preferably by the order of 10% of its inlet section, while the shape of the section of the tube is constant from its inlet 13 to its outlet 14 and, in this example, is an oval shape visible in FIGS. 7 and 8, the wall of each tube having two opposed flats 15 parallel to the major axis 16 of the oval section of the tube. Each tube such as 12 is curved into an almost complete loop in the plane of FIG. 6, over most of its length starting from its inlet 13, and its downstream part is, in addition, bent or bent back in a direction perpendicular to the plane of FIG. 6, as depicted in FIGS. 2 and 7. Thanks to the flats 15 and to their curved shapes, two tubes such as 12*a* and 12*b*, grouped into a pair of tubes for each supplying one of two adjacent cylinders respectively, can touch along their flats 15 over most of their lengths starting from their inlets 13*a* and 13*b* (see FIG. 8), while their outlets 14*a* and 14*b* (see FIG. 7) are separated from one another so that each can be connected in leaktight fashion to a respective one of two supply openings 7 neighboring one another in the flange 8 so as to supply the corresponding two cylinders.

Figure 9:
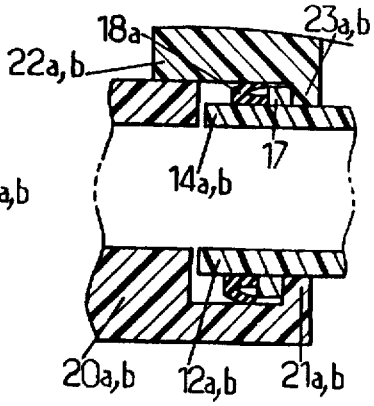
Figure 11:
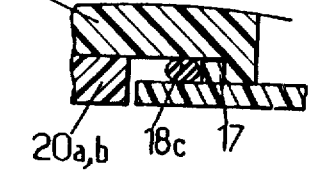
Figure 10:
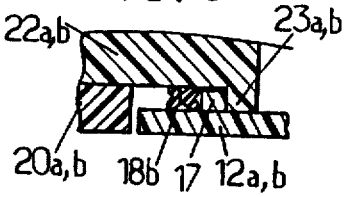

A ring 17, for example made of thermoweldable plastic, with an internal section that corresponds in terms of shape and in terms of surface area to the external section of each tube such as 12 near its outlet 14 is attached and fixed by thermowelding, for example by the known welding method known as "mirror welding" around the tube near its outlet 14 to form an annular shoulder projecting radially outward. Then a flexible and annular seal 18 which, by way of nonlimiting examples, may be the lip seal 18*a* of FIG. 9, the cross-shaped seal 18*b* of FIG. 10 or the O-ring seal 18*c* of FIG. 11, is mounted around the outlet end part of each tube such as 12, between its ring 17 and its outlet 14. The two tubes 12*a* and 12*b* grouped in pairs of touching tubes, as in FIG. 7, with their ring 17 and their seal 18 (not depicted in FIG. 7) are then placed in the downstream half shell 3. The outlet end, with the ring 17 and the seal 18, of each of the tubes 12*a* and 12*b* is fitted into a cradle 20*a* and 20*b* respectively molded integrally with the half shell 3 and the flange 6. This cradle 20*a*, 20*b* projects from the flange 6 on the opposite side to the engine cylinder head and is more or less in the shape of a semicylinder open toward the parting plane P and delimiting a central passage which extends a corresponding opening 7 toward the inside of the half shell 3. At its end within the half shell 3, each cradle 20*a*, 20*b* has an annular chamber delimited by an annular end wall 21*a*, 21*b* projecting radially toward the inside of the cradle 20*a*, 20*b* to form a stop that prevents the ring 17 and the seal 18 on the outlet end of the tube 12*a* and 12*b* from coming out axially. As this outlet end of the tube 12*a* or 12*b* is fitted in the cradle 20*a* or 20*b*, the seal 18 (such as 18*a*, 18*b* or 18*c*) around the tube is compressed radially between the tube and the cradle 20*a*, 20*b*. The retention of each of the tubes 12*a* and 12*b* in the cradle 20*a* or 20*b* of the half shell 3, and its leaktight connection to the corresponding opening 7, by virtue of the seal, are supplemented by a stirrup piece 22*a* or 22*b* attached transversely to that end part of the tube that is engaged in the cradle 20*a* or 20*b* and bearing via its periphery against the edges of this cradle, the stirrup piece 22*a*, 22*b* having a rim 23*a*, 23*b* in the shape of an annular end wall protruding toward the inside of the cradle 20*a*, 20*b* and facing the rim 21*a*, 21*b* thereof. This stirrup piece 22*a*, 22*b* is molded from plastic and welded by ultrasound welding around its periphery to the edges of the cradle 20*a* or 20*b*. The tube is thus held in place and its connection to the corresponding opening 7 sealed thanks to the seal and to a manifold end piece formed by the cradle 20*a* and 20*b* and the corresponding stirrup piece 22*a* or 22*b*, the latter having, as shown in the sectional views of FIGS. 4 and 5, a recess that complements that of the cradle 20*a* or 20*b* to define a duct of a section that varies progressively connecting the oval outlet 14*a* or 14*b* of the tube to the circular section of the corresponding opening 7, as depicted in the sectional view of FIG. 3. The cradle 20*a*, 20*b* and the corresponding stirrup piece 22*a*, 22*b* are molded in such a way that their recesses exhibit this corresponding change in section.

The two tubes 12*a* and 12*b* are also held in the downstream half shell 3 by a second stirrup piece 24, also molded from plastic, which transversely straddles these two tubes 12*a* and 12*b* in their touching part, and which is preferably fixed by plastic snap rivets 25 protruding toward the parting plane P in the half shell 3, and engaged in holes at the ends of the second stirrup piece 24 so that they can then be thermally flattened onto the latter. Thus, the stirrup piece 24 keeps the tubes 12*a* and 12*b* pressed against a base 26 formed by an increased-thickness part of the half shell 3 protruding toward the inside of the latter.

As the tubes 12*a* and 12*b* have been blow-molded with overall radius of curvature smaller than the radius of curvature of the rounded parts of the half shells 2 and 3 of the envelope 1, it is possible in this way to avoid contact and rubbing between the tubes and the upstream half shell 2 when the two half shells 2 and 3 are being vibration-welded together, which operation involves small back and forth relative displacements of the half shells 2 and 3 causing friction between the flanges 4 and 5 leading to thermal welding. Note, incidentally, that contact between the tubes and the downstream half shell 3 is limited to contact with the stirrup piece 24 and the base 25 and a contact of the ring 17 of the outlet end of the tubes 12*a*, 12*b* with the tubular end piece consisting of the cradle 20*a* or 20*b* and the stirrup piece 22*a* or 22*b*, which means that any possible source of disrupting rubbing between the tubes and the two parts of the envelope, which rubbing might lead to breakage during the vibration-welding phase which is the final phase in the assembly of the manifold, is avoided.

This then yields a manifold in which the envelope 1 delimites an internal chamber 27, known as a plenum chamber, which is supplied with air for supplying the engine via an opening (not depicted) for example made in the center of an end face of the envelope 1 parallel to the plane of FIG. 1, this opening being connected to a butterfly body. Each tube such as 12*a* or 12*b* mounted in the envelope 1 draws air from the plenum chamber 27 via its inlet 13*a* or 13*b* and transfers this air via its outlet 14*a* or 14*b* to a supply opening 7 in the flange 6 for supplying a corresponding cylinder. It will be understood that the envelope 1 contains, in the half not depicted in FIG. 2, two more air-induction tubes symmetric with the tubes 12*a* and 12*b* and mounted in the same way.

The inlet manifold embodiment in FIGS. 12 and 13 has many features in common with the one which has just been described, which means that similar elements are denoted by the same numerical references, annotated with a prime symbol, and that in what follows, merely the differences between this second embodiment and the first will be described.

First of all, the tubes 12'*a* and 12'*b* have a circular cross section. However, they also touch along a part of their length and are pressed by a stirrup piece 24' against a support base 26' inside the downstream half shell 3', the stirrup piece 24' being, as in the previous embodiment, fixed by snap riveting or thermal welding to stakes 25' of this half shell 3'.

Likewise, the outlet ends of the tubes 12'a and 12'b are surrounded by a ring 17' and a flexible seal 18' and each is connected in leaktight fashion to a corresponding opening 7' in the flange 6' for attachment to the cylinder head by a tubular end piece. However, in this embodiment, the end piece consists of a cradle 20'a or 20'b of U-shaped cross section of constant size, with an annular end wall forming an internal radial stop 21'a or 21'b on the same side as the half shell 3', as well as a stirrup piece 22'a or 22'b which is basically flat with a stop 23'a or 23'b in the shape of an arc of a circle projecting toward the inside of the cradle 20'a or 20'b and facing the annular end wall 21'a or 21'b thereof. The manifold end piece thus produced for each outlet end of a tube 12'a or 12'b preferably has a circular section of constant diameter with one face, pointing toward the corresponding tube, which is flat and perpendicular to the axis of the tube in its outlet end part. The cylindrical seal 18' is, in this example, compressed axially via its two flat and radial end faces between, on the one hand, the flat radial face of the ring 17', which points toward the flange 6' and, on the other hand, a flat radial face pointing toward the inside of the half shell 3' in the end wall of the corresponding cradle 20'a or 20'b on the flange 6', these various radial faces being more or less perpendicular to the axis of the tube 12'a or 12'b at its outlet.

In the two embodiments described above, the tubes, just like the half shells, may be made of a plastic such as polyamide, filled with reinforcing fibers.

We claim:

1. An inlet manifold for an internal combustion engine, comprising:

an envelope delimiting a plenum chamber to be supplied with air for supplying an engine via a variable-delivery valve, and equipped with at least one flange for attaching it to a cylinder head of the engine, said at least one flange having at least one supply opening for supplying each cylinder of an engine, each supply opening being open, on the one hand, into the envelope and, on the other hand, into a face for attaching said at least one flange to the cylinder head, and air-induction tubes each made as a single piece with a desired shape, corresponding in number to a number of cylinders in the engine, and which are mounted in the envelope so that each of the air-induction tubes supplies a corresponding cylinder with air which each of the air induction tubes receives via its inlet in a plenum chamber and which each of the air-induction tubes transmits to a corresponding opening in said at least one flange via its outlet connected to its at least one supply opening by leaktight connection means comprising a tubular end piece in which an outlet end part of an air-induction tube is held in said envelope with an insertion of at least one flexible seal between an induction tube and a tubular end piece, wherein each said tubular end piece is made with, on the one hand, a cradle integral with said at least one flange and projecting from an opposite side to a cylinder head, in line with a corresponding supply opening, said cradle being of a generally semi-cylindrical shape, of which an end inside said envelope has an annular end wall forming a stop projecting toward an inside of said cradle and, on the other hand, a stirrup piece for holding said tube in said cradle, said stirrup piece having a stop projecting toward an inside of said cradle and facing an annular end wall of said cradle, a ring being attached and fixed around said tube close to its air outlet, said flexible seal being attached around said tube between said ring and said air outlet of said tube, the outlet end part of said tube with said ring and said seal being in place in said corresponding cradle in such a way that said ring or said seal is retained by butting against said annular end wall of said cradle, said stirrup piece being attached to said cradle and a part of said tube which is held therein, and being fixed to the edges of said cradle.

2. An inlet manifold according to claim 1, wherein the internal surface of each tube is substantially smooth and continuous from its inlet to its outlet.

3. An inlet manifold according to claim 1, wherein said envelope comprises two molded half shells with complementary shapes corresponding to a shape of said envelope and arranged one against the other and secured together via their peripheral edges in a parting plane (P), to form said envelope with said tubes between them, each of said tubes being blow molded, from a thermomoldable plastic, and said flange being integral with one of said half shells.

4. An inlet manifold according to claim 1, wherein each of said tubes is made with a section that decreases progressively in a downstream direction with respect to at least one member selected from the group consisting of at least part of its length and a convergent bell-socket-shaped air inlet.

5. An inlet manifold according to claim 1, wherein each of said tubes is made with a section that has generally a same shape from its air inlet to its air outlet.

6. An inlet manifold according to claim 3, wherein said tubes are grouped at least in pairs of tubes that touch over at least part of their length, wherein said tubes of each group of tubes are fixed into one and the same half shell which has an attachment flange with supply openings to which said tubes of said group are connected in leaktight manner, using at least one second stirrup piece which transversely straddles touching tubes of said group, in their touching part, and which is attached via its ends to said half shell.

7. An inlet manifold according to claim 6, wherein each of said tubes is made with an oval section and flats, parallel to a major axis of its section, on its opposed facing faces, and said tubes are grouped together, touching along their flats.

8. An inlet manifold according to claim 6, wherein the half shells with their bases, on the one hand, and the stirrup pieces, on the other hand, are components molded from plastic, and the second stirrup pieces are fixed to corresponding half shells by a means for fixing selected from the group consisting of welding and snap riveting.

9. An inlet manifold according to claim 3, wherein said tubes are curved with a radius of curvature, in a plane containing their axis, smaller than that of said envelope; the half shells of the envelope are molded of plastic with securing flanges along their edges in the parting plane (P), and the half shells are secured together to form said envelope by welding at the securing flanges.

10. An inlet manifold according to claim 3, wherein each end piece holds a corresponding tube on one of the half shells to which each cradle is secured.

11. An inlet manifold according to claim 1, wherein said seal between said outlet end part of each of said tubes and the corresponding end piece is provided by axially compressing said seal, which is cylindrical, via its flat end faces between a flat radial face, pointing toward the inside of said envelope, of said cradle and of said flange, said radial faces being generally perpendicular to the axis of said tube at its outlet.

12. An inlet manifold according to claim 1, wherein each cradle and a corresponding stirrup piece are molded in such a way that said end piece formed by said cradle and said stirrup piece has a cross section that changes progressively from a circular shape, on the same side as the attachment flange and its circular supply opening, to an oval shape which complements that of said tubes.

13. An inlet manifold according to claim 12, wherein said seal between said outlet end part of each of said tubes and the corresponding end piece is provided by radially compressing said seal between, on the one hand, said tube and, on the other hand, said cradle and said corresponding stirrup piece.

* * * * *